US006044685A

United States Patent [19]

Delgado et al.

[11] Patent Number: 6,044,685

[45] Date of Patent: Apr. 4, 2000

[54] CLOSED-DIE FORGING PROCESS AND ROTATIONALLY INCREMENTAL FORGING PRESS

[75] Inventors: Hugo E. Delgado, Arlington; Timothy E. Howson, Westborough; Jack M. Hyzak, Shrewsbury; Paul D. Antaya, Sutton; Thomas F. Doherty, Bellingham; Paul J. Gargolinski, Holden; Peter R. Jepson, Newbury; Martin M. Morra, Worcester; James E. Shannon, III, North Grafton, all of Mass.

[73] Assignee: Wyman Gordon, North Grafton, Mass.

[21] Appl. No.: 08/919,803

[22] Filed: Aug. 29, 1997

Related U.S. Application Data

[60] Provisional application No. 60/033,250, Dec. 6, 1996, and provisional application No. 60/038,493, Feb. 24, 1997.

[51] Int. Cl.[7] ..... B21J 5/02

[52] U.S. Cl. ..... 72/356; 72/377

[58] Field of Search ..... 72/356, 377; 29/894.01

[56] References Cited

U.S. PATENT DOCUMENTS

| | | | |
|---|---|---|---|
| 602,196 | 4/1898 | Ralston | 72/356 |
| 965,039 | 7/1910 | Slick | 29/894.01 |
| 1,449,385 | 3/1923 | Dieterich . | |
| 1,560,135 | 11/1925 | Bell . | |
| 3,443,412 | 5/1969 | Webb et al. . | |
| 3,521,472 | 7/1970 | Bringewald . | |
| 3,575,035 | 4/1971 | Nokes . | |
| 3,638,471 | 2/1972 | Martin . | |
| 3,750,450 | 8/1973 | Sharp et al. . | |
| 3,847,004 | 11/1974 | Bringewald . | |
| 4,051,708 | 10/1977 | Beane et al. . | |
| 4,055,975 | 11/1977 | Serfozo et al. . | |
| 4,074,559 | 2/1978 | Beane et al. . | |
| 4,096,730 | 6/1978 | Martin . | |
| 4,391,118 | 7/1983 | Martin . | |
| 4,516,299 | 5/1985 | Martin . | |
| 4,545,232 | 10/1985 | Martin et al. . | |
| 4,580,431 | 4/1986 | Oku et al. . | |
| 4,803,880 | 2/1989 | Hopkins et al. . | |
| 5,592,847 | 1/1997 | Sarkisian et al. . | |

FOREIGN PATENT DOCUMENTS

| | | |
|---|---|---|
| 1-289531 | 11/1989 | Japan . |

*Primary Examiner*—Lowell A. Larson

[57] ABSTRACT

A forging press includes a die set having a stationary die, a movable die in facing-but-spaced-apart relation to the stationary die along a press axis and defining a workpiece volume therebetween, and an exterior constraint extending circumferentially around the workpiece volume. The movable die has a base level region lying generally in a workpiece plane perpendicular to the press axis, and three rotationally symmetric segments raised above the base level region. Each of the segments forms an angular segment of a disk having an included segment angle and that is angularly separated from the other segments. A press mechanism includes a axial drive operable to move the movable die in a direction parallel to the press axis, and an indexing drive operable to rotate the movable die about the press axis by an indexing rotational angle. In operation, the axial drive performs a press stroke and retracts, the indexing drive rotates the movable die by the indexing rotational angle of less than the included segment angle, and the axial drive performs another press stroke. By repeating these steps, the entire workpiece is forged incrementally.

18 Claims, 5 Drawing Sheets

= POTENTIAL WEIGHT SAVINGS (30%)

CLOSED-DIE FORGING PROCESS AND ROTATIONALLY INCREMENTAL FORGING PRESS

This application claims the benefit of U.S. Provisional Application Ser. No. 60/033,250, filed Dec. 6, 1996, and U.S. Provisional Application Ser. No. 60/038,493, filed Feb. 24, 1997, the disclosures of which are hereby incorporated herein by reference.

BACKGROUND OF THE INVENTION

This invention relates to a forging method for generally axisymmetric articles and to a forging press wherein generally axisymmetric articles are forged in an incremental fashion.

In forging, a workpiece is compressed between two or more forging dies by a machine termed a forging press. The workpiece plastically deforms to a new shape determined by the shapes of the forging dies and the amount of compression. The forging may be accomplished in a single press stroke, or there may be multiple press strokes to gradually deform the workpiece to the required final shape of the article.

The forging operation thins the workpiece in the direction of force application and causes it to enlarge in the perpendicular plane. The workpiece is thereby deformed to the final forged shape. The final forged shape must be distinguished from the final article shape, because in general it is not possible or desirable to forge the workpiece to precisely the final desired article shape. The degree to which the final forged shape approximates that of the final desired article determines the difficulty of the forging operation to some degree. It is relatively easy to uniformly forge the workpiece over its entire plan view area, termed pancake forging. However, in a typical situation involving a complexly shaped final desired article, pancake forging leaves large amounts of material to be machined away to reach the details of the shape of the final desired article. In a more-advanced approach to forging, the workpiece is forged to a near-net-shape (NNS) configuration that closely approximates the shape of the final article but is intentionally slightly oversize to permit ultrasonic inspection, removal of sufficient material to account for distortion experienced during heat treatment, and final machining of the details. In this NNS forging approach, the amount of metal machined away is relatively small. NNS forging requires considerably more ingenuity in designing the forging process than does pancake forging.

Forging is used in a wide variety of operations to produce both small and large articles. To deform the workpiece, a forging press must apply the required force. The production of large articles is particularly challenging because the larger the article, the larger is the required forging force. Consequently, a larger and more expensive forging press is needed to accomplish the forging. As noted, NNS forging usually requires greater forging forces, and thence a larger forging press, than pancake forging.

In some cases, it is desired to produce an article whose size and material of construction are such that the force capacity of the available forging press is exceeded. To forge such articles, it is known to incrementally forge the workpiece using an open-die forging operation. In incremental open-die forging, the design of the forging dies and the operation of the forging press are such that only a portion of the workpiece is forged at any one time. The workpiece is moved incrementally relative to the forging dies after each region is forged, eventually leading to complete forging of the entire workpiece. Unfortunately, open-die forging and incremental open-die forging cannot achieve near-net-shape configurations for most articles, because the unconstrained portion of the workpiece is allowed to expand to whatever size and configuration results, rather than to a near net shape.

In one application, a workpiece is forged into an axisymmetric turbine disk for use in a large land-based gas turbine. Such turbine disks are as much as 70–96 inches in diameter or larger. They are made of nickel-base or iron-base superalloys and cannot be forged to a desired near-net-shape geometry even on a press having a capacity of 50,000 tons. The axisymmetric near-net-shape, dimensional, and mechanical property requirements of the final turbine disks are quite stringent. The existing incremental forging techniques for such disks cannot meet these requirements.

Accordingly, there is a need for an improved approach to the forging of large axisymmetric articles. The present invention fulfills this need, and further provides related advantages.

SUMMARY OF THE INVENTION

The present invention provides an incremental forging press and technique for producing large, axisymmetric, near-net-shape (NNS) forgings. The shapes, dimensions, and mechanical properties of the forgings are acceptable for precision applications such as final machining to large land-based turbine disks. In the final forging operation, only a portion of the workpiece is contacted by the forging dies in each forging stroke, so that the size of the workpiece may be larger than otherwise possible for an available forging press capacity. The required amount of final machining of the article is significantly reduced as compared with prior approaches, resulting in greatly reduced material waste. The latter is important, because a significant part of the cost of the forging is the material cost of the workpiece, which is a nickel-base superalloy. Reducing the amount of material which must be machined away reduces the manufacturing cost of the article.

In accordance with the invention, a method of forging a workpiece is operable with a generally axisymmetric, disk-shaped starting workpiece having a plan view area. The method includes first forging the starting workpiece over substantially its entire plan view area, and thereafter incrementally forging the first-forged workpiece to a final forged configuration. In the first forging operation, the starting workpiece is forged with a (non-incremental) forging die that extends over substantially the entire plan view area. Preferably, a radially inner portion of the workpiece is forged to about its final forged configuration, but a radially outer portion of the workpiece is not forged to its final forged configuration. In the following step of incremental forging, the radially outer portion of the workpiece is preferably incrementally forged to its final forged configuration without substantially altering the radially inner portion of the workpiece, although there may be some relatively minor deformation of the radially inner portion of the workpiece in the incremental forging step.

The approach of the invention allows the forging of radially larger, substantially axisymmetric articles by closed-die forging than is possible with conventional, non-incremental closed-die forging techniques. A maximum forging capacity of a forging press is defined by the largest size article that may be forged by the forging press using closed-die, non-incremental forging. The use of incremental closed-die forging allows the forging of a larger (but otherwise identical) article using the same press and forging conditions. In accordance with this aspect of the invention, a method of forging an oversize workpiece comprises the steps of furnishing a forging press having a forging press maximum force capacity sufficient to forge an axisymmetric article of a non-incrementally forged maximum final size by closed-die, non-incremental forging, under a set of forging conditions. The method further includes furnishing an axisymmetric workpiece, and incrementally forging the workpiece by closed die forging in the forging press under the set of forging conditions, to form an incrementally forged article having an incrementally forged final size greater than the non-incrementally forged maximum final size. In order to make a fair comparison, all other forging conditions such as material, temperature, forging rate, and geometric similarity are the same, and only the dimensions of the workpiece and the dies are scaled. "Size" refers to the radial dimension measured outwardly from the axis of symmetry.

The incremental forging is preferably closed die incremental forging leading to a near-net-shape final forged shape that closely approximates that of the desired final article but is slightly oversize to permit ultrasonic inspection, removal of material to account for distortion in heat treatment, and final machining. The available incremental open-die forging presses and techniques are not operable in this application to produce a near net shape, and it was therefore necessary to develop a closed-die forging press and technique for forging the axisymmetric, generally disk-shaped workpiece resulting from the first forging step.

In accordance with this aspect of the invention, a forging press comprises a stationary die having a stationary die face, and a movable die having a movable die face in facing-but-spaced-apart relation to the stationary die face along a press axis. The stationary die face may be flat or may be patterned with a pattern that is to be imposed into the facing side of the workpiece. The movable die face comprises a base-level region lying generally in a workpiece plane perpendicular to the press axis, and at least one segment, and preferably exactly three rotationally symmetric segments, raised above the base-level region. Each of the segments comprises an angular segment of a disk having a disk axis parallel to the press axis and having an included segment angle relative to the press axis. Where there is more than one segment, each of the segments is angularly separated from the other segments. There is further an exterior, circumferentially extending constraint to prevent radial expansion of a workpiece when the workpiece is pressed between the stationary die and the movable die. That is, the forging is a closed-die forging rather than an open-die forging. The exterior constraint is preferably a circumferentially extending wall, which may be separate from, or integral with, the stationary die. The space enclosed by the stationary die, the movable die, and the exterior constraint defines a workpiece volume that receives the workpiece therein. A press mechanism comprises an axial drive operable to move the movable die in a direction parallel to the press axis, and an indexing drive operable to rotate the movable die about the press axis by an indexing rotational angle. The axial movement of the movable die and the rotational movement of the indexing drive are operable only in an alternating fashion when the movable die is in contact with the workpiece, although the rotational and axial movements may be concurrent when the movable die is retracted and no longer contacts the workpiece.

More generally, a forging press comprises a die set comprising a stationary die and a movable die in facing-but-spaced-apart relation to the stationary die along a press axis. There is an exterior constraint extending circumferentially around the workpiece volume. The space enclosed by the stationary die, the movable die, and the exterior constraint defines a workpiece volume that receives the workpiece therein. At least one of the stationary die and the movable die has a raised feature thereon. The same press mechanism as described above is used.

In the preferred embodiment, there are three or more symmetric segments raised above the base-level region of the movable die. In cooperation with the exterior constraint that produces closed die-forging, these segments deform the portion of the workpiece immediately under each segment so that it flows generally in a radially outwardly direction, although there is typically some local lateral and/or inward flow to fill features defined by the segments. They also produce a deformation state in the portions of the workpiece that are not under the segments to cause that metal to flow.

The sides of the segments that transition to the base-level regions on each side of each segment are preferably inclined at a draft angle of from about 45 to about 60 degrees. In the absence of this draft angle, there may be folds or cracks introduced into the facing side of the workpiece which cannot be removed in subsequent forging strokes.

In operation of the incremental forging press, a workpiece is placed into the workpiece volume. A first forging stroke of the forging press in the axial direction forges a portion of the workpiece. The force on the forging die is released, and the die is withdrawn. The indexing drive is activated to rotate the movable die about the press axis by an indexing rotational angle, and the axial drive delivers another forging stroke. The process is repeated as necessary to forge the entire workpiece.

The present forging press and forging method provide an important advance in the art of the forging of large axisymmetric articles. The forged article has better near-net-shape definition and is larger than could otherwise be produced by an available closed-die forging press capacity. The forged article is forged to a near-net-shape configuration that reduces the overall material and machining requirements and thus the cost of the article. Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
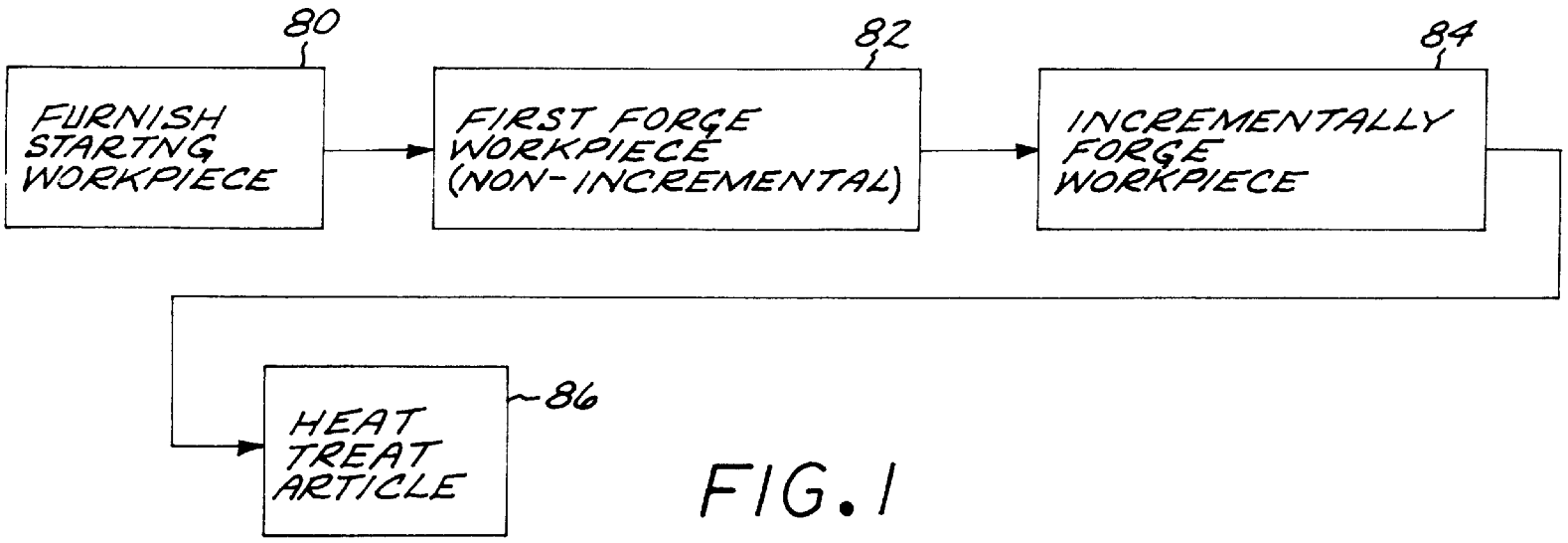
FIG. 1 is a block flow diagram of a preferred forging process.
Figure 2:
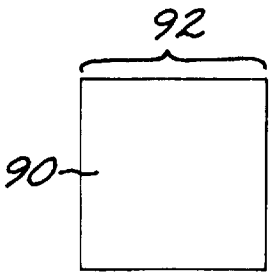
FIG. 2 is a schematic elevational view of a starting workpiece.

FIG. 1 illustrates a preferred approach for practicing the processing aspect of the present invention. A starting workpiece is provided, numeral 80. The starting workpiece may be made of any forgeable metal, such as, for example, steel, an aluminum alloy, an iron-base superalloy, a nickel-base superalloy, or a titanium alloy. The size of the starting workpiece is such that it contains a sufficient volume of metal to form the final forged shape, in locations such that the metal flows toward the final forged shape. The design of the starting workpiece is performed using any available forging metal-flow design technique. For an axisymmetric land-based turbine rotor of particular interest to the inventors having a final diameter of about 70–96 inches and a thickness of about 20 inches, an axisymmetric starting workpiece 90 is a cylinder about 31 inches in diameter and about 65–75 inches tall, illustrated in FIG. 2. The starting workpiece has a starting plan view area 92, which is the area of the end of the workpiece contacted by the forging die in the first forging step.

Figure 3:
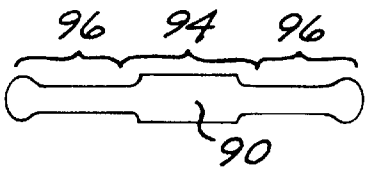
FIG. 3 is a schematic elevational view of the workpiece after the first, non-incremental forging.

The starting workpiece is first forged, numeral 82, using conventional, nonincremental forging procedures. In the first forging operation, the forging die extends over substantially the entire plan view area 92 as deformation proceeds. The forging die may be either a closed die or an open die, but is preferably a closed die. The shape of the forging die in this first forging is primarily flat, although the die may have shape definition near its center portion. The workpiece is deformed toward the final desired shape, with the primary direction of metal flow radially outwardly. There may be multiple forging substeps and reheating of the workpiece within the scope of the first forging operation 82 in order to define the resulting workpiece shape. The die preferably forms the workpiece to about its final shape in a radially inner portion 94 of the workpiece 90, as shown in a defined hub region in FIG. 3. However, there is no attempt to forge a radially outer portion 96 of the workpiece 90 to its final forged configuration. The radially outer portion 96 typically deforms to a somewhat-bulbous shape, as illustrated in FIG. 3, if the first forging is open die, or to a more constrained shape if the first forging is closed die. It is often not possible to forge the radially outer portion 96 of the workpiece 90 to its final forged shape, because the forging press has insufficient force capacity to cause the metal to flow into the required near-net-shape configuration.

Figure 4:
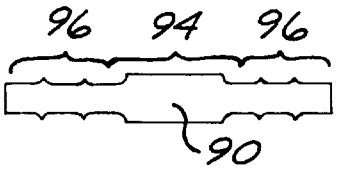
FIG. 4 is a schematic elevational view of the workpiece after completion of the incremental forging.

After the first forging 82 is complete, the workpiece is incrementally forged by closed-die forging, numeral 84. The necessary incremental forging apparatus and technique have not heretofore been available, and an incremental forging apparatus and technique developed by the inventors are discussed subsequently. In incremental forging, the forging die contacts only a portion of the plan view area of the workpiece 90. Desirably, most of the forging force is concentrated into circumferential segments of the radially outer portion 96 of the workpiece 90. Relatively little forging force and deformation are applied to the radially inner portion 94, although there may be some forging of the radially inner portion 94. At the conclusion of the incremental forging step 84, the workpiece 90 has been formed to a near-net-shape article as shown in FIG. 4, having the radially inner portion 94 defined primarily in step 82, and the radially outer portion 96 defined primarily in step 84. This approach is preferred, but the present method is operable in other situations such as where step 82 is instrumental in defining the final shape of radially outer portion 96 or where step 84 is instrumental in defining the final shape of the radially inner portion 94.

The article in its final shape may thereafter optionally but preferably be heat treated, numeral 86.

The present combination of non-incremental, first forging and incremental closed-die final forging has been developed to forge large, complex workpieces to near net shape. It is not intended to replace all conventional forging technology, because it is more expensive to practice than conventional non-incremental forging. However, where the final forged disk shape cannot be attained by conventional forging due to the limitation of the force capacity of the forging press or other reasons, the present approach is useful and may permit near-net-shape fabrication of such large forgings and the realization of the consequent cost savings in material, machining, and other costs.

Figure 5:
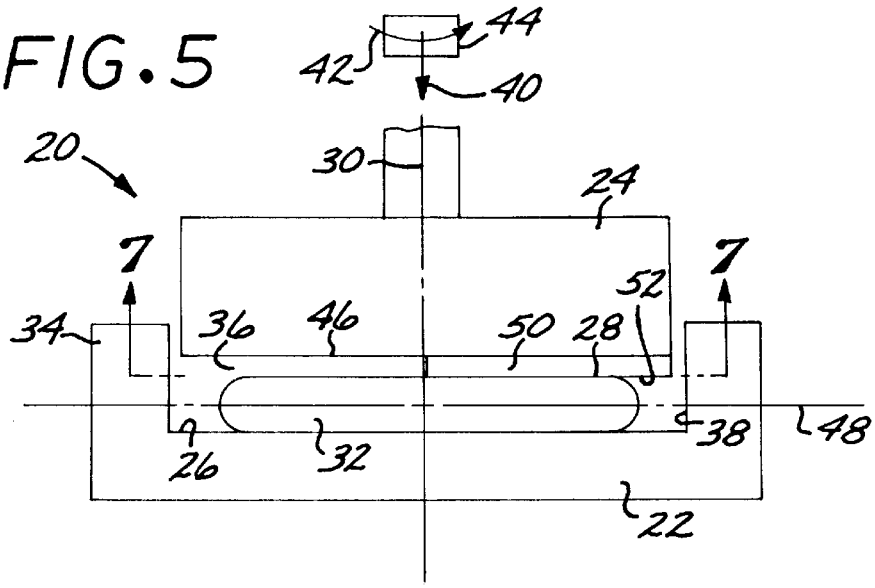
FIG. 5 is a schematic sectional view of a forging apparatus according to the invention.

As indicated, an incremental forging apparatus has been developed for use in the above-described process and for other applications. FIG. 5 illustrates a forging press 20 having a stationary die 22 and a movable die 24. The stationary die 22 is illustrated as the bottom die and the movable die 24 is illustrated as the top die, although the reverse arrangement may be used as well. It is preferred that the stationary die 22 be on the bottom, as the workpiece rests on the bottom die. The stationary die 22 has a stationary die face 26, and the movable die 24 has a movable die face 28. The stationary die face 26 and the movable die face 28 are in a facing but spaced apart relationship along a press axis 30. The dies 22 and 24 are preferably generally axisymmetric, although their faces may not be axisymmetric and may instead have non-symmetric features thereon. A workpiece 32 is positioned between the dies 22 and 24.

A radial exterior constraint in the form of a circumferentially extending wall 34 extends around the periphery of the workpiece 32. The dies 22 and 24, together with the circumferentially extending wall 34, define a fully contained, closed-die workpiece volume 36 in which the workpiece 32 is received. The circumferentially extending wall 34 may be in the form of a separate annular ring or may be integral with the stationary die 22. In the view of FIG. 5, prior to starting the forging operation, the workpiece 32 may or may not contact an inwardly facing face 38 of the circumferentially extending wall 34. During forging, the workpiece 32 is compressed axially parallel to the press axis 30 and expanded radially by radially outward metal flow to contact the inwardly facing face 38 of the circumferentially extending wall 34, which constrains further radial expansion of the workpiece 32.

This forging within a constrained volume is the essence of closed-die forging and results in important advantages over open-die forging. The constraining of the outwardly radial plastic flow of the metal in closed-die forging forces the metal to flow into features defined by the dies and/or the wall. In open-die forging, on the other hand, the outwardly radial plastic flow of the metal is unconstrained so that the metal being forged, following the path of least resistance, flows radially outwardly and does not flow into features defined by the dies that are necessary to produce near-net-shape articles. Thus, closed-die forging achieves results not possible with open-die forging, including the fabrication of near-net-shape articles having surface features defined by the forging dies.

Figure 6:
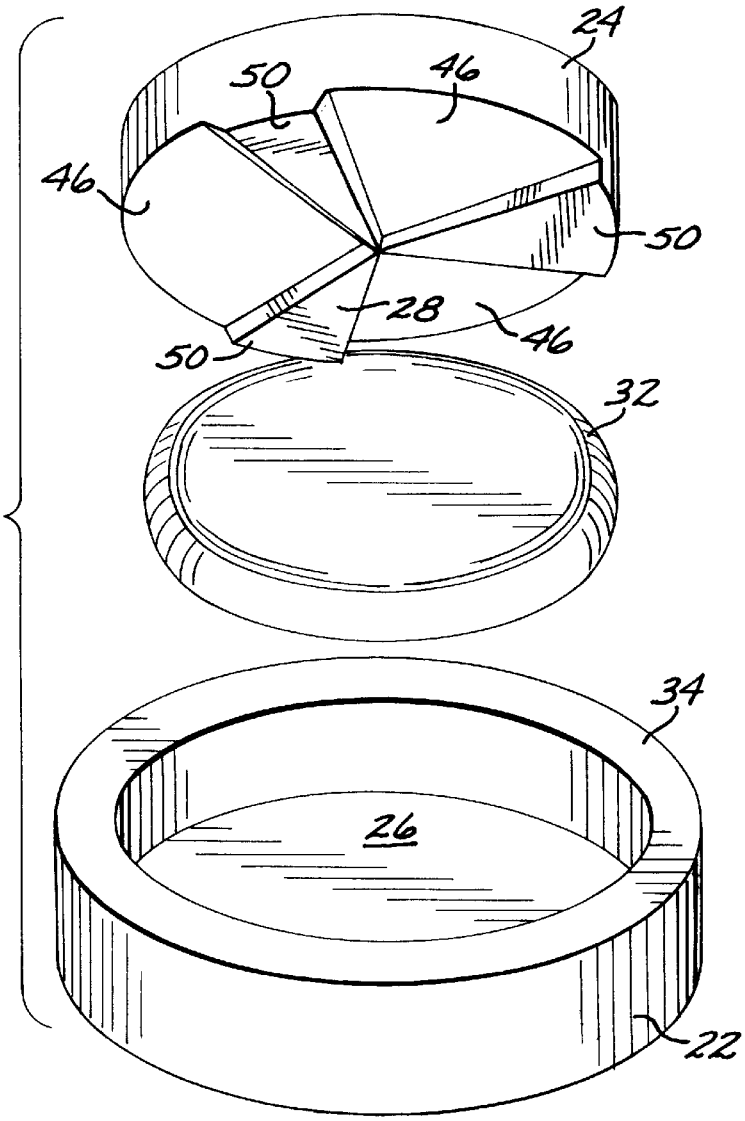
FIG. 6 is an exploded perspective view of the forging apparatus of FIG. 5.

FIG. 6 shows the dies 22 and 24, the circumferentially extending wall 34, and the workpiece 32, in exploded perspective view.

The movable die 24 is movable parallel to the press axis 30 and toward the fixed die 22 in a forging stroke, as indicated by an axial arrow 40 in FIG. 5, and also is rotatable in an indexing fashion around the press axis 30, as indicated by a rotational arrow 42. (The movable die is also movable in the opposite directions as well.) Only one of the movements in the forging-stroke direction 40 and the rotational direction 42 may be accomplished at one time when the movable die 24 contacts the workpiece 32, so that the movements are alternating in a manner to be discussed subsequently. When the movable die 24 is retracted and not in contact with the workpiece 32, both axial and rotational movements may be accomplished simultaneously. The movable die 24 is moved by a press mechanism 44 which provides these two degrees of movement 40 and 42, a preferred form of which will be discussed subsequently.

The stationary die face 26 may be substantially flat. It may instead have a pattern of features thereon. The flat or patterned character of the stationary die face 26 is impressed upon the facing side of the workpiece 32 (the bottom side of the workpiece in the drawings) during the forging operation.

The movable die face 28 has two types of features thereon, arranged circumferentially. These features may be seen in FIGS. 5–8. One of the features is at least one, preferably at least three, and most preferably exactly three, fan-shaped base-level regions 46 that are substantially flat and lie generally parallel to a workpiece plane 48 perpendicular to the press axis 30. The other of the features is an equal number of fan-shaped segments 50 which are flat or patterned on their upper surfaces 52 and also lie parallel to the workpiece plane 48. As shown in FIG. 8, a plane 54 of the segment upper surfaces 52 is longitudinally displaced along the press axis 30, toward the stationary die face 26, from a plane 56 of the base level regions 46. Stated alternatively, the segments 50 are raised above the base level regions 46. The number of base level regions 46 is exactly the same as the number of segments 50.

There must be at least one of the segments 50. If there is more than one segment 50, the segments are preferably arranged symmetrically with the equal number of base level regions 46 on the face of the movable die. That is, if there are two, three, four, or more segments 50, they should be axisymmetrically arranged when viewed in a plan view to minimize asymmetric loading of the forging press. If there are fewer than three segments 50, there is a concern that the loads on the segments will be too high and that the press will become asymmetrically loaded. For very large capacity presses such as the 50,000 ton press used by the present inventors, considerations of asymmetric loading are important for achieving the desired configuration and structure of the article, for the stability and longevity of the machinery, and for the safety of workers. For more than three segments 50, the segments increasingly subtend a relatively narrow circumferential angle. They therefore tend to act more in the manner of cookie cutters that bite into the metal rather than deform the metal by forging, resulting in ineffective flow of the workpiece. These theoretical and practical considerations have resulted in the selection of a die face with three segments 50 and three alternating base-level regions 46 (as illustrated in FIG. 7) as being preferred, although die faces with lesser or greater numbers of segments 50 are operable in some circumstances.

The segments 50 are symmetrically spaced around the movable die face 28, with individual segments 50 subtending a segment angle A. One of the base-level regions 46 is positioned between each of the segments 50, and subtends a base-level region angle C. The total of the multiple segment angles A, summed for the segments 50, plus the total of the multiple base-level region angles C, summed for the base-level regions 46, is 360 degrees.

The included segment angle A is preferably from about 45 to about 65 degrees. If A is substantially smaller, the die tends to "dive" into the workpiece with the cookie-cutter effect mentioned above. If A is substantially larger, the die becomes more similar to a conventional flat or contoured die and there is little press-capacity leveraging effect of the incremental forging process. The angle C is defined by the angle A and the number of segments 50.

Figure 7:
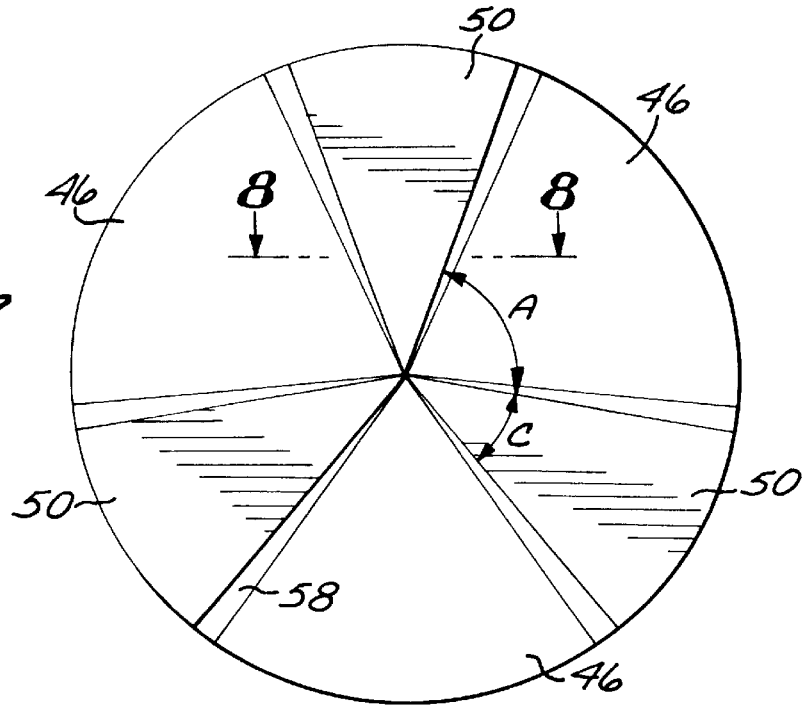
FIG. 7 is a plan view of the movable die, taken along line 7—7 of FIG. 5.
Figure 8:
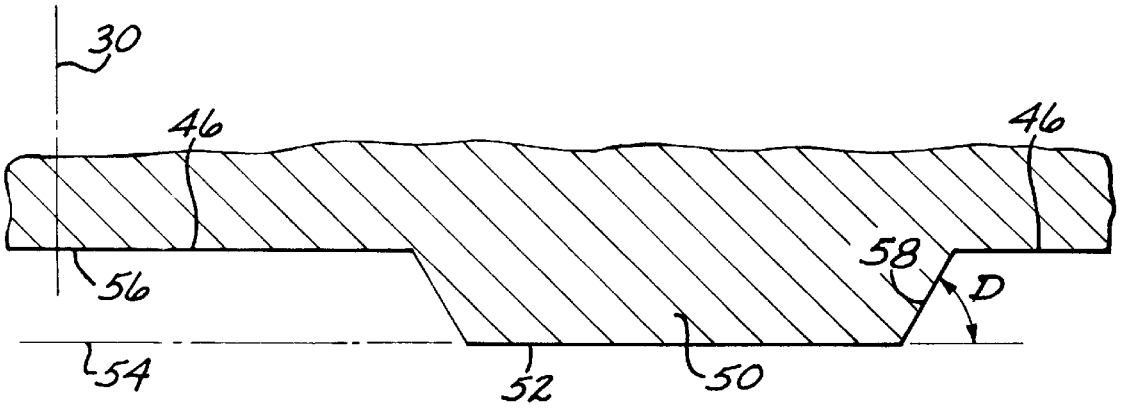
FIG. 8 is a sectional view of the movable die, taken along line 8—8 of FIG. 7.

The geometry of the segments 50 is illustrated in FIGS. 7 and 8. The segments 50 are pie-slice shaped and are, when depicted in plan view as in FIG. 7, segments of a circle. In a cross-sectional view of FIG. 8, the segment 50 includes a sloped segment side 58 extending between the upper surface 52 of the segment 50 and the base-level region 46. The segment sides 58 may also be seen as very narrow slices in the plan view of FIG. 7.

The segment side 58 is oriented at a draft angle D to the plane 54 of the upper surface 52 of the segment 50. The draft angle D is preferably from about 45 to about 60 degrees. If the draft angle D is substantially smaller than about 45 degrees, the segment angle A is effectively enlarged, and the leveraging effect for press capacity is reduced. If the draft angle D is substantially larger than about 60 degrees, the diving or cookie-cutter effect is observed. Defects such as folds and cracks may be produced in the surface of the workpiece 32 during the incremental forging to be described subsequently. These defects, once introduced, cannot be fully removed during subsequent forging or other operations.

To perform forging using the incremental forging step 84 or otherwise, the workpiece 32 is placed between the stationary die 22 and the movable die 24. The press mechanism 44 is operated to move the movable die face 28 in the direction 40 toward the stationary die face 26 in a first forging stroke. The workpiece 32 is deformed under the stress states discussed previously. The press mechanism 44 is reversed, withdrawing the movable die 24 away from contact with the workpiece 32. The press mechanism 44 is operated to rotate the movable die 24 by some preselected amount about the press axis 30 in an indexing movement. The amount of rotation is selected in conjunction with the number of segments 50 and the angles A and C, as well as the materials properties, the shape, the required definition, and the size of the workpiece. The amount of rotation in each indexing movement is less than angle A. The stronger the material, the smaller is the indexing rotation. The indexing rotation is typically from about 40 to about 60 degrees, for the preferred case. In a typical case, where there are three segments 50 and the angle A is 55 degrees, the preferred indexing rotation is about 40 degrees. After the rotational movement is complete, the press mechanism 44 is again operated to move the movable die face 28 in the direction 40 toward the stationary die face 26 in a second forging stroke. After the workpiece is deformed, the press mechanism 44 is reversed, withdrawing the movable die 24 away from contact with the workpiece 32. The press mechanism 44 is operated to rotate the movable die 24. These steps are repeated as many times as necessary to complete the forging. For the preferred case where there are three segments 50, the angle A is 55 degrees, and the press indexing rotation is 40 degrees, a total of three forging strokes is required to complete one deformation set. Multiple deformation sets may be used for thick forgings or forgings where the strength of the workpiece material is high. The workpiece is normally at elevated temperature during forging, and cools during the forging operation. The workpiece may be reheated as often as necessary during the forging operation in order to reduce its flow stress and also to achieve particular microstructures in the workpiece.

The preceding discussion has addressed the incremental forging press in general form applicable to any press-type loading device. The application of interest to the inventors is the forging of large disks for land-based gas turbines from nickel-base superalloys or titanium alloys using a 50,000 ton, closed-die, vertical forging press. The large size of the workpiece and the large forging loads lead to special considerations for the dies and for the press mechanism.

Figure 9:
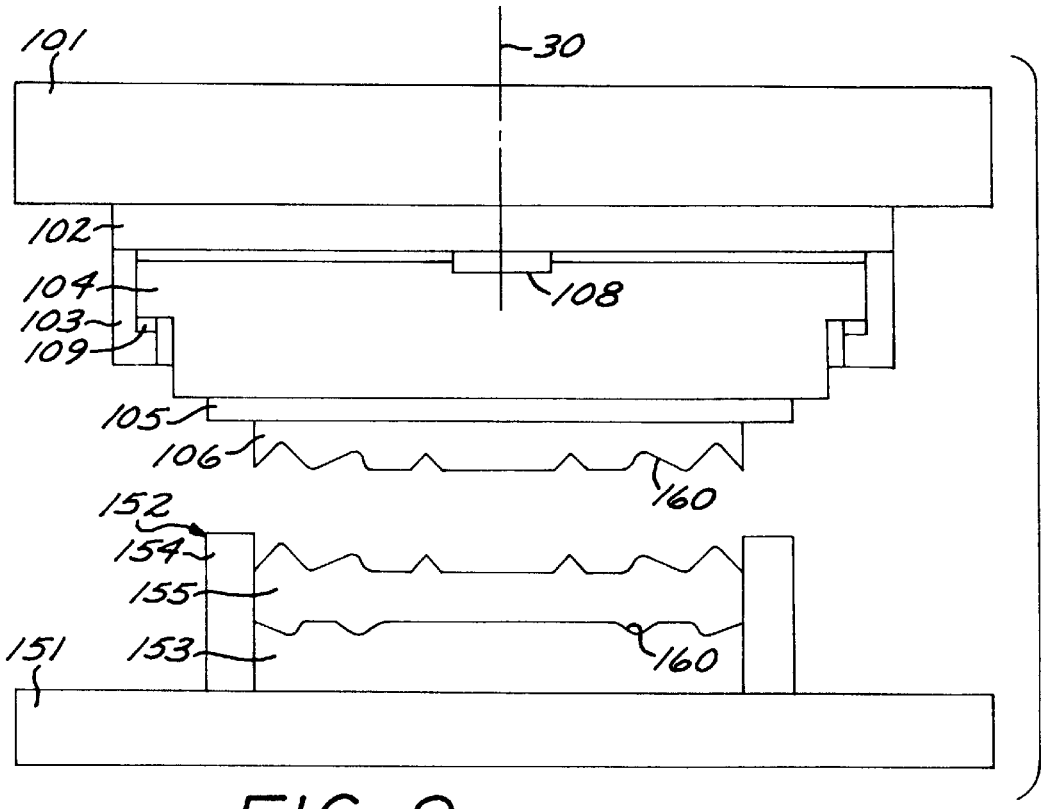
FIG. 9 is an elevational view of a large-capacity forging press with the movable die retracted.
Figure 10:
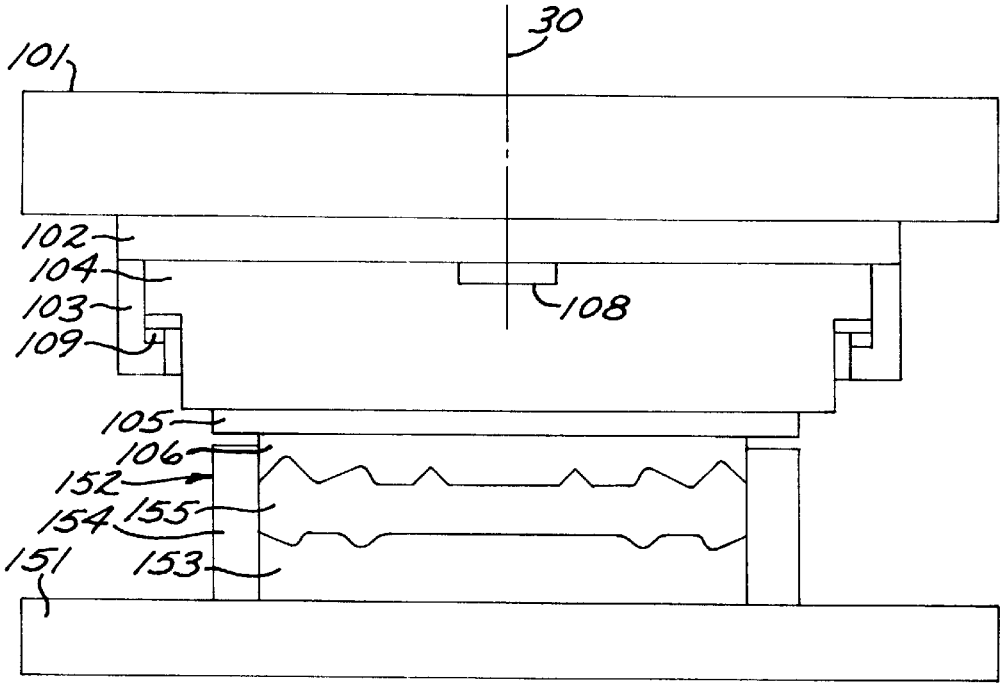
FIG. 10 is an elevational view like that of FIG. 9, with the movable die contacting the workpiece.

Referring to FIGS. 9 and 10, an upper bolster 101 is the moving element of the forging press. Bolted to the upper bolster is a base 102, and bolted to the base 102 is a ring 103. A rotating bolster 104 is rotatably held within the ring 103. A top die adapter 105 is bolted to the rotating bolster 104. A top die 106, corresponding to the movable die 24 discussed previously, is bolted to the top die adapter 105. The rotating bolster 104 is mounted on a centering pin 108, which allows the rotating bolster 104 to rotate about the press axis 30 and allows the rotating bolster 104 to move up and down within the ring 103. The centering pin 108 prevents the rotating bolster 104 from moving radially with respect to the press axis 30.

A lower bolster plate 151 carries a lower die 152, corresponding to the stationary die 22, which includes a bottom die 153 and an annular ring 154. The bottom die 153 and the annular ring 154 form the lower die cavity, with the workpiece 155 resting within the lower die cavity.

In the withdrawn, press open position of FIG. 9, the rotating bolster 104 rests on bearing pads 109 mounted on the inside of the ring 103. These bearing pads 109 allow the rotating bolster 104 to be easily rotated about the press axis 30 by a hydraulic cylinder (not shown), to accomplish the rotating indexing movement. A smooth, trouble-free rotation with relatively rapid movement is desirable, to increase forging press throughput and also to allow a heated workpiece to be forged rapidly while it is still sufficiently hot. The indicated approach permits that rotation even in a large forging press structure.

As shown in FIG. 10, during a forging stroke when the top die 106 contacts the workpiece 155, the rotating bolster 104 is pushed upwardly off the bearing pads 109 and against the underside of the base 102. The frictional contact between the rotating bolster 104 and the base 102 resists rotation.

Figure 11:
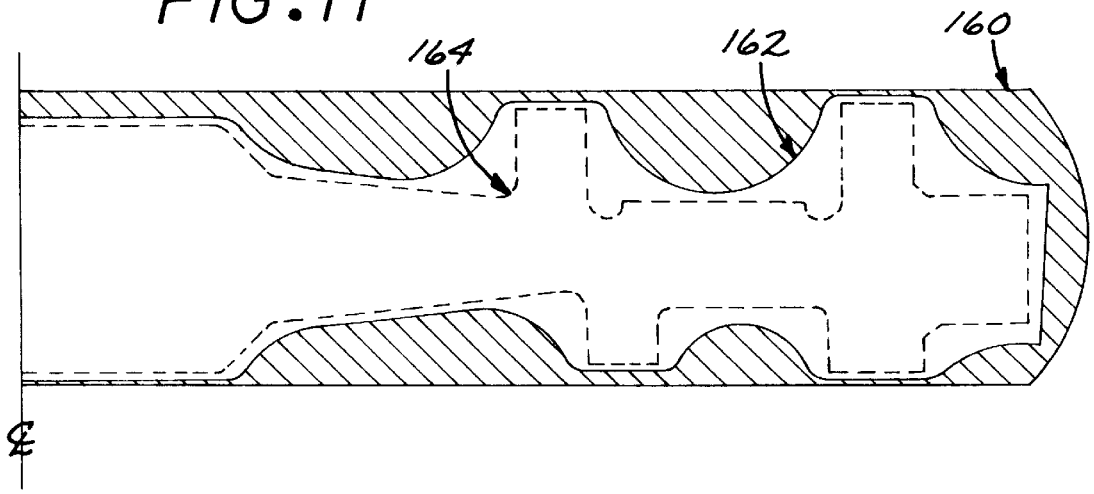
FIG. 11 is a sectional view of a turbine disk forged to a near net shape.

The use of the featured dies such as the dies 106 and 153 permits the article to be forged to a near net shape by closed-die forging, as illustrated in FIG. 11. The profile of a conventional flat pancake forging 160, conventionally prepared by open-die forging with opposing flat dies, is overlaid onto a profile of a near-set-shape forging 162, prepared with relief dies 106 and 153, and the final-machined article 164. In each case, any excess material must be machined away to make the final article. For both the pancake forging and the near-net-shape forging, at least some final machining must be performed. However, that final machining is much less for the near-net-shape, closed-die forging than for the pancake open-die forging. The shaded area indicates the extra material that must be machined away from the pancake open-die forging in excess of that which must be machined away from the near-net-shape forging, in this case amounting to about 30 percent of the volume of the pancake forging. When the workpiece is made of an expensive nickel-base superalloy, as is the case for high-performance land-based gas turbines, the difference between the purchased material cost and the scrap cost of the excess nickel-base superalloy material can amount to a high fraction of the total cost of the article, such as about 10–20 percent or more. The present approach thus offers a substantial variable cost saving in material cost, as well as a substantial fixed cost savings in that the article may be forged on a press of lower capacity than would otherwise be the case.

The forging of articles such as turbine disks from nickel-base superalloys is typically performed with the workpiece at elevated temperature. For example, to forge a large disk for a land-based turbine, where the final disk has a diameter of 70–96 inches, has a weight of more than 15,000 pounds, and is made of a nickel-base superalloy such as Inconel 706, the workpiece is heated in an oven to a forging temperature above its solvus temperature and specifically to a forging temperature of about 1825° F. The recrystallized workpiece is transferred to the forging press and forged. The workpiece cools over time to the solvus temperature and then to a temperature below the solvus temperature. The required forging force increases as the workpiece cools and its flow stress increases, but the incremental forging processing allows the forging to proceed. The final incremental forging strokes are preferably performed at a temperature below the solvus at about 1750° F. to attain a relatively small grain size of ASTM 3–5. Metallurgical studies have demonstrated that the metallurgical structures obtained with the incremental forging press and with the procedure such as illustrated in FIG. 1 are substantially the same as the structures achieved with conventional forging and heat-treating procedures (but which cannot be successfully performed on the very large workpieces of most interest here). The above discussion is specific to Inconel 706, one of the preferred materials of the inventors for use with the present invention. For other materials, other detailed processing may be desirable and is within the scope of the present invention.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method of forging a workpiece, comprising the steps of furnishing an axisymmetric starting workpiece having a plan view area;

first forging the starting workpiece over substantially its entire plan view area; and thereafter incrementally forging the first-forged workpiece to a final forged configuration by indexed rotational movement of a movable forging die about a press axis between axial forging strokes of the movable forging die parallel to the press axis.

2. The method of claim 1, wherein the step of first forging includes the step of first forging the starting workpiece with a forging die that extends over substantially the entire plan view area, such that a radially inner portion of the workpiece is forged to about its final forged configuration, and a radially outer portion of the workpiece is not forged to about its final forged configuration.

3. The method of claim 2, wherein the step of incrementally forging includes the step of incrementally forging the radially outer portion of the workpiece to its final forged configuration without substantially altering the radially inner portion of the workpiece.

4. The method of claim 1, wherein the step of incrementally forging includes the step of incrementally forging the workpiece in a closed die.

5. The method of claim 1, wherein the step of incrementally forging includes the step of forging the workpiece to a near-net-shape turbine disk.

6. A forging press, comprising:

a stationary die having a stationary die face;

a movable die having a movable die face in facing-but-spaced-apart relation to the stationary die face along a press axis, the space between the stationary die and the movable die defining a workpiece volume, the movable die face comprising a base level region lying generally in a workpiece plane perpendicular to the press axis, and at least one segment raised above the base level region, each of the segments comprising an angular segment of a disk having a disk axis parallel to the press axis and having an included segment angle relative to the press axis, each of the segments being angularly separated from the other segments;

an exterior constraint extending circumferentially around the workpiece volume, the exterior constraint preventing radial expansion of a workpiece in the workpiece volume when the workpiece is pressed between the stationary die and the movable die; and a press mechanism comprising an axial drive operable to move the movable die in a direction parallel to the press axis, and an indexing drive operable to rotate the movable die about the press axis by an indexing rotational angle, the axial drive and the indexing drive being operable only in an alternating fashion.

7. The forging press of claim 6, wherein each of the segments has a radially extending segment side between the segment and the circumferentially adjacent base level region, and wherein each of the segment sides has a draft angle of from about 45 to about 60 degrees relative to the workpiece plane.

8. The forging press of claim 6, wherein the exterior constraint comprises a circumferentially extending wall having a substantially constant radius relative to the press axis.

9. The forging press of claim 6, wherein the included segment angle is from about 45 to about 65 degrees.

10. The forging press of claim 6, wherein the indexing rotational angle is from about 40 to about 60 degrees.

11. The forging press of claim 6, wherein there are exactly three segments.

12. The forging press of claim 6, wherein there are exactly three segments, the included segment angle is about 55 degrees, and the indexing rotational angle is about 40 degrees.

13. A forging press, comprising:

a die set comprising a stationary die;

a movable die in facing-but-spaced-apart relation to the stationary die along a press axis, the space between the stationary die and the movable die defining a workpiece volume, and an exterior constraint extending circumferentially around the workpiece volume, at least one of the stationary die and the movable die having a raised feature thereon; and a press mechanism comprising an axial drive operable to move the movable die in a direction parallel to the press axis, and an indexing drive operable to rotate the movable die about the press axis by an indexing rotational angle.

14. The forging press of claim 13, wherein the feature comprises a radially extending feature side between the feature and an adjacent region, and wherein the feature side has a draft angle of from about 45 to about 60 degrees.

15. The forging press of claim 13, wherein the exterior constraint comprises a circumferentially extending wall having a substantially constant radius relative to the press axis.

16. The forging press of claim 13, wherein the feature comprises:

a base level region lying generally in a workpiece plane perpendicular to the press axis, and at least three rotationally symmetric segments raised above the base level region, each of the segments comprising an angular segment of a disk having a disk axis parallel to the press axis and having an included segment angle relative to the press axis, each of the segments being angularly separated from the other segments.

17. A forging press, comprising:

a stationary die having a stationary die face;

a movable die having a movable die face in facing-but-spaced-apart relation to the stationary die face along a press axis, the space between the stationary die and the movable die defining a workpiece volume, the movable die face comprising a base level region lying generally in a workpiece plane perpendicular to the press axis, and exactly three rotationally symmetric segments raised above the base level region, each of the segments comprising an angular segment of a disk having a disk axis parallel to the press axis and having an included segment angle of from about 45 to about 65 degrees relative to the press axis, each of the segments being angularly separated from the other segments;

an exterior constraint comprising a wall extending circumferentially around the workpiece volume and integral with the stationary die, the exterior constraint preventing radial expansion of a workpiece in the workpiece volume when the workpiece is pressed between the stationary die and the movable die; and a press mechanism comprising an axial drive operable to move the movable die in a direction parallel to the press axis, and an indexing drive operable to rotate the movable die about the press axis by an indexing rotational angle.

18. The forging press of claim 17, wherein the stationary die face is patterned.

* * * * *